US005592200A

United States Patent [19]

Kaneko

[11] Patent Number: 5,592,200

[45] Date of Patent: Jan. 7, 1997

[54] INK JET APPARATUS CAPABLE OF PRACTICING AN IMPROVED RECOVERY OPERATION

[75] Inventor: Mineo Kaneko, Yokohama, Japan

[73] Assignee: Canon Kabushiki Kaisha, Tokyo, Japan

[21] Appl. No.: 955,018

[22] Filed: Oct. 1, 1992

[30] Foreign Application Priority Data

Oct. 3, 1991 [JP] Japan ..... 3-256542

[51] Int. Cl.[6] ..... B41J 2/165

[52] U.S. Cl. ..... 347/30; 347/23

[58] Field of Search ..... 346/140 R, 75; 400/126; 347/29, 30, 86, 23

[56] References Cited

U.S. PATENT DOCUMENTS

| | | | |
|---|---|---|---|
| 3,345,262 | 8/1982 | Shirato et al. | 346/140 R |
| 4,313,124 | 1/1982 | Hara | 346/140 R |
| 4,459,600 | 7/1984 | Sato et al. | 346/140 R |
| 4,463,359 | 7/1984 | Ayata et al. | 346/1.1 |
| 4,558,333 | 12/1995 | Sugitani et al. | 346/140 R |
| 4,577,203 | 3/1986 | Kawamura | 346/75 |
| 4,586,058 | 4/1986 | Yamazaki et al. | 346/140 |
| 4,723,129 | 2/1988 | Endo et al. | 346/1.1 |
| 4,740,796 | 4/1988 | Endo et al. | 346/1.1 |
| 4,967,204 | 10/1990 | Terasawa et al. | 346/1.1 |
| 4,970,533 | 11/1990 | Saito et al. | 346/140 R |
| 4,970,534 | 11/1990 | Terasawa et al. | 346/140 R |
| 5,231,416 | 7/1993 | Terasawa et al. | 346/140 |
| 5,311,214 | 5/1994 | Hirasawa et al. | 346/1.1 |

FOREIGN PATENT DOCUMENTS

| | | | |
|---|---|---|---|
| 0480473 | 4/1992 | European Pat. Off. . | |
| 2589788 | 5/1987 | France . | |
| 0087569 | 7/1980 | Japan | 347/92 |
| 59-123670 | 7/1984 | Japan . | |
| 59-138461 | 8/1984 | Japan . | |
| 0249759 | 11/1986 | Japan | 346/140 |
| 0077940 | 4/1987 | Japan | 346/140 |
| 62-109655 | 5/1987 | Japan . | |
| 63-224958 | 9/1988 | Japan . | |
| 2184066 | 6/1987 | United Kingdom . | |

*Primary Examiner*—N. Le

*Attorney, Agent, or Firm*—Fitzpatrick, Cella, Harper & Scinto

[57] ABSTRACT

An ink jet apparatus performs recording by ejecting, from the head portion ink which is contained in an exchangeable ink jet cartridge for the apparatus to form desired images on a recording medium. The apparatus performs a suction recovery operation for the head portion when the ink jet cartridge is removed from the apparatus. With this suction recovery, all the ink in the ink passage between the ink jet cartridge to the recording head is exhausted through the head portion; thus making it possible to remove bubbles remaining in ink totally and easily without any additional components and any resultant contamination in the nozzles provided for the recording head.

16 Claims, 5 Drawing Sheets

INK JET APPARATUS CAPABLE OF PRACTICING AN IMPROVED RECOVERY OPERATION

BACKGROUND OF THE INVENTION

1. Field of the Invention

The present invention relates to an ink jet apparatus capable of practicing an improved recovery operation to be performed when ink tank cartridges are replaced.

2. Related Background Art

As an ink jet recording apparatus, there has hitherto been known a method whereby to perform recording by ejecting ink from the recording head utilizing the pressure which is exerted by changes in the state of ink using electrothermal transducers. In a recording apparatus of this kind, the dissolved gaseous component is deposited in ink due to boiling of the ink. As a result, there may be some cases where bubbles are not resolved again and are caused to remain in the recording head. If this condition is repeated, the remaining bubbles gradually enter the ink passage by the flow of ink, and may hinder the ejection of the ink. Also, there is a case where the remaining dissolved gas in ink is deposited due to the environmental changes and unintentionally developed; thus hindering proper ink ejection.

According to experiments conducted by the inventor hereof, the bubbles thus developed may become a size presenting such a problem when 30 to 40 A-3 sized sheets are printed with 100% duty. Therefore, in order to avoid producing any adverse effects on the ink ejection, such bubbles must be removed. For a conventional ink jet recording apparatus, there is known a method as general means for removing bubbles in which ink and bubbles in the recording head are sucked by providing an airtight cap airtightly covering the front end of the recording head to generate negative pressure in the cap in such a state by means of a pump connected to the cap.

However, in the above-mentioned conventional example, if there is a staged portion between a common liquid chamber and an ink passage as shown in FIG. 5A, such portion is stagnated to make it easier to collect the bubbles. In addition, not much ink flows even when ink is sucked and thus it becomes difficult to remove bubbles, particularly small ones. Also, when a target bubble is large as shown in FIG. 5B, the bubble is partially exhausted with the majority thereof still remaining as shown in FIG. 5C, which will be again developed while several sheets are being printed; hence creating a problem that the ingression of bubbles to the nozzles may take place. As described earlier, the liquid passage of the recording head is divided into a plurality of nozzles 14 for ejecting recording liquid each having an electrothermal transducer 18 and a common liquid chamber 15, serving as a reservoir, for; ink to be supplied to the nozzles 14 through filters 20 between a substrate 19 and a ceiling plate 17. Now, since the common liquid chamber needs a capacity which is as large as several tens to several hundreds of times that of the nozzle portion, it is inevitable that rapid configurational changes occur between the nozzle portion and the common liquid chamber to generate stagnation at that point. As a method to solve a problem of this kind, there is disclosed, for example, a method in Japanese Patent Laid-Open Application No. 63-224958 wherein airtight cap made of a resilient material is provided to cover the recording head and still in such a state, the cap is depressed so as to deform the resilient material. Thus, the air in the cap is compressed into the interior of the head through the discharging ports thereof to allow it to be combined with the air which has pressed the bubbles in the ink passage and the common liquid chamber and then in a state that the liquid passage is made empty, ink is again filled in the interior of the recording head by the suction of a pump. This method, however, may present a possibility that the unwanted liquid forms dust and the like in the cap which is also compressed into the nozzles simultaneously because this method requires the air to be compressed from the front end of the foregoing head. Also, the resilient material of the cap must be deformed for this purpose. Therefore, it is necessary that the resilient material to be used is more durable, and that a special mechanism is arranged to deform it; thus creating a problem that the structure becomes inevitably complicated.

Also, as another means in this respect, there is a method such as disclosed in Japanese Patent Laid-Open Application No. 62-109655 wherein a branch is provided for a part of the ink supply passage for the recording head and the ink tank cartridge and by enabling it to be opened to or closed from the atmospheric air by the use of a valve or the like in order to empty from such a branched portion to the recording head portion with the air inducted therefrom; thus obtaining the same effect as the foregoing method whereby to compress the air from the cap. Although this method has an advantage that the induction of air can be conducted appropriately, it still presents a problem that its mechanism becomes extremely complicated in order to provide a portion which can be opened to the atmospheric air for the ink supply passage.

Now, the bubbles are generated not only in the recording head portion, but also in the ink supply passage from the ink tank cartridge to the recording head depending on the environmental changes. The bubbles of these types cannot be removed sufficiently by any one of the foregoing methods and as ink supply is repeated, the bubbles in the ink supply passage may enter the head portion.

SUMMARY OF THE INVENTION

With a view to solving the above-mentioned problems, the present invention is designed, and it is an object of the invention to provide an ink jet recording apparatus capable of practicing an improved recovery operation to prevent any defective printings by removing with simply means the bubbles in the recording head and ink supply passage, which are not easily removable otherwise.

It is another object of the present invention to provide an ink jet apparatus for forming desired images on a recording medium by ejecting from the head portion the ink contained in an exchangeable ink jet cartridge for the apparatus, wherein a suction recovery operation is performed for the foregoing head portion when the aforesaid ink jet cartridge is removed from the aforesaid apparatus.

It is still another object of the present invention to provide an ink jet apparatus which comprises the following:

exchangeable an ink jet cartridge capable of holding ink to be supplied to the head portion which ejects the ink to form desired images, an ink supply passage for supplying ink between the foregoing head portion and the ink jet cartridge;

suction recovery means for covering the discharging ports of the aforesaid head portions to suck ink;

means for detecting the removal of the foregoing ink jet cartridge from the apparatus; and means for operating the suction of ink from the foregoing head portion by operating the aforesaid suction recovery means when the removal of the ink jet cartridge is detected by the foregoing detecting means.

It is a further object of the present invention to provide an ink ejection recovery operation whereby to remove the ink cartridge containing the ink to be supplied to the recording head for ejecting the ink through the ink supply passage and to operate suction operation for exhausting from the discharging ports of the recording head the total quantity of the ink in the foregoing ink supply passage and recording head subsequent to the removal of the foregoing ink cartridge.

It is still a further object of the present invention to provide an ink jet apparatus for performing the formation of images on a recording medium by ejecting from the head the ink which is contained in an exchangeable ink cartridge for the apparatus, wherein the apparatus comprises the following:

installation detecting means for detecting whether the foregoing ink cartridge is installed or not;

suction means for covering the recording head airtightly to suck ink from the recording head by suction;

installation detecting means for detecting the removal of the foregoing ink cartridge and the installation of a new ink cartridge; and control means for driving suction the means each time the removal and installation are detected and to perform recovery of the ejecting function of the aforesaid recording head by operating suction with suction means.

DETAILED DESCRIPTION OF THE EMBODIMENTS

Figure 1:
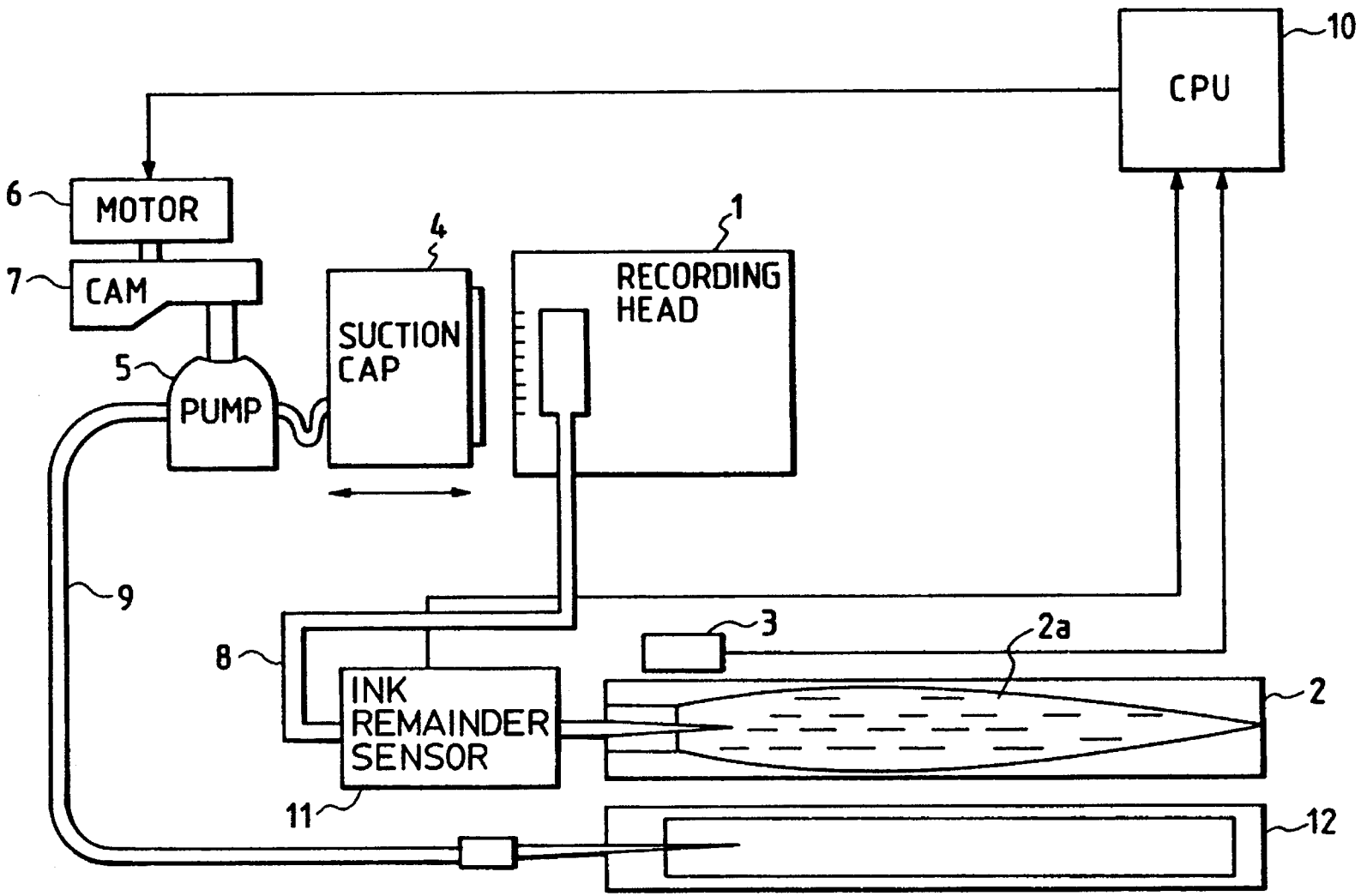
FIG. 1 is a view schematically showing the structure of an embodiment of an ink jet apparatus according to the present invention.
Figure 2:
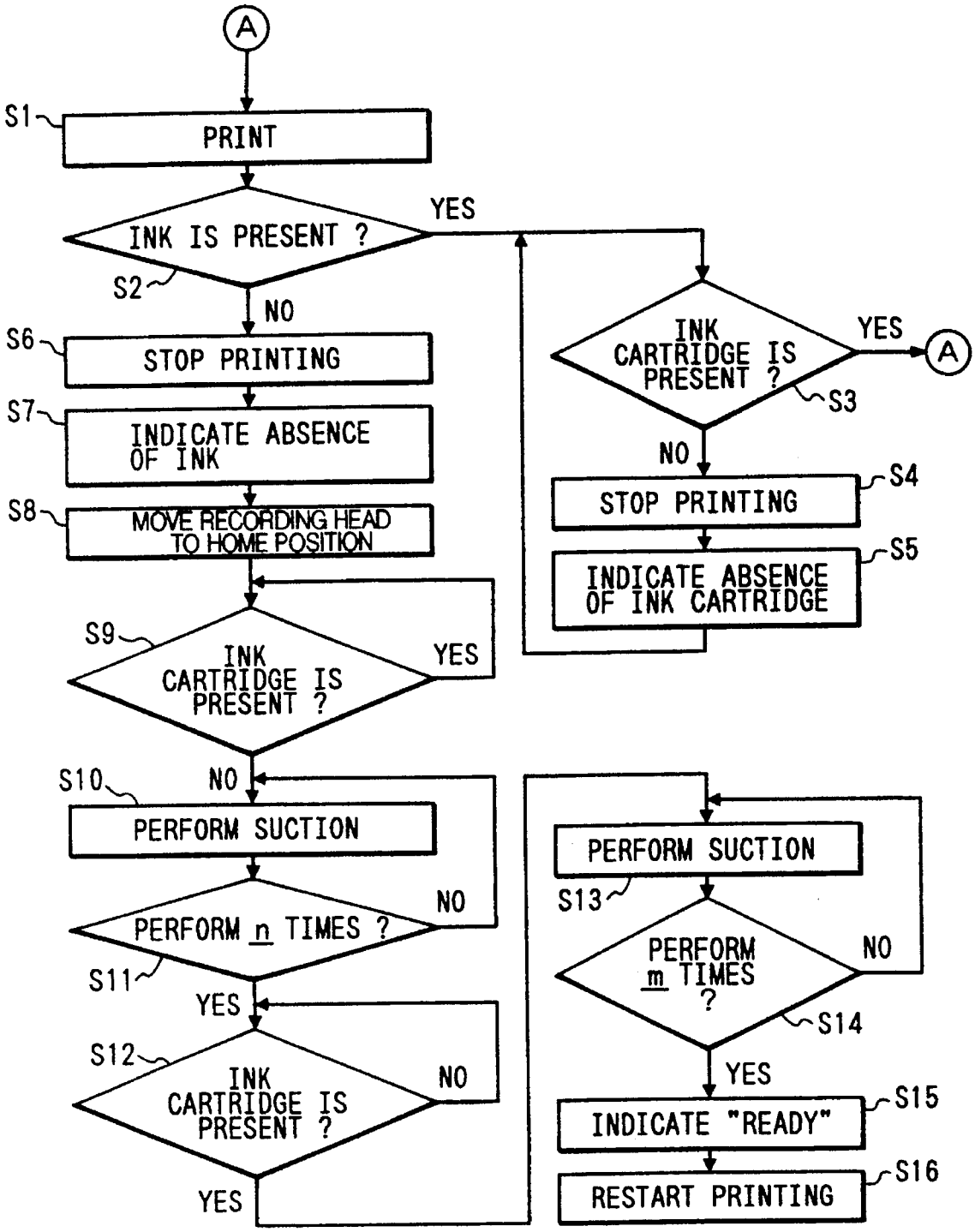
FIG. 2 is a flowchart showing the operation of the embodiment shown in FIG. 1.

Now, with reference to the accompanying drawings, the description will be made of the embodiments according to the present invention. FIG. 1 is a view schematically showing the structure of an ink jet apparatus according to an embodiment of the present invention. FIG. 2 is a flowchart showing the operation of the embodiment shown in FIG. 1.

Figure 4:
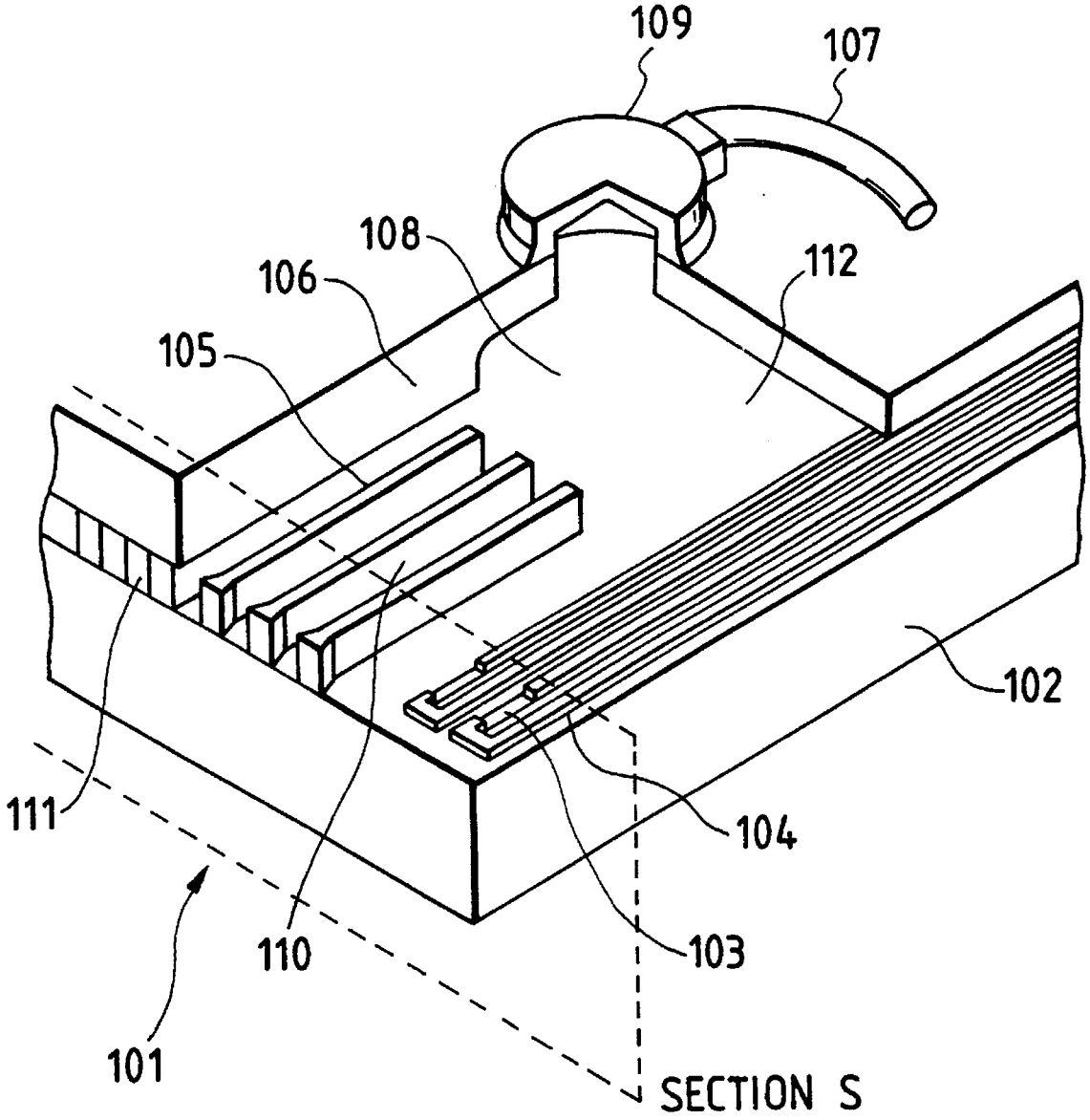
FIG. 4 is a structural view illustrating a recording head.
Figure 5A:
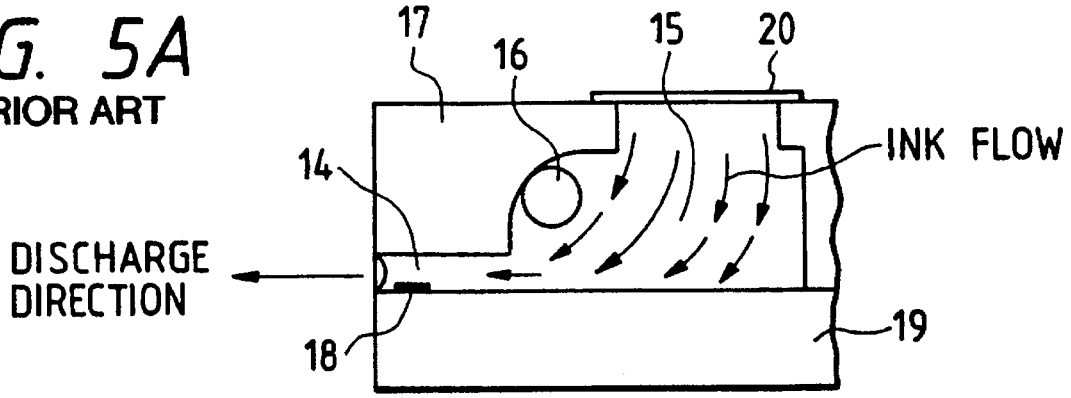
FIG. 5A PRIOR ART
FIGS. 5A, 5B, and 5C are views illustrating the generation of bubbles in the conventional examples.
Figure 5B:
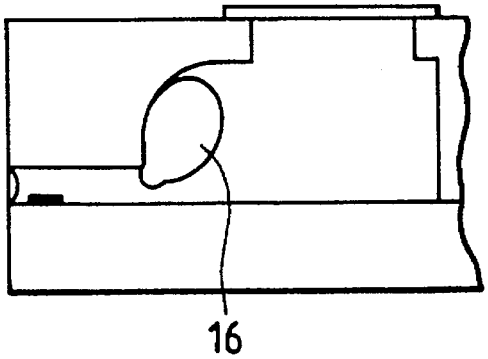
FIG. 5B PRIOR ART
Figure 5C:
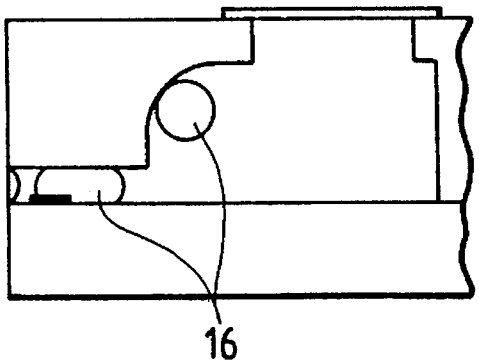
FIG. 5C PRIOR ART

A recording head 1 is to perform recording by ejecting ink from the discharging ports onto a recording sheet in response to printing signals. One example therefor will be described with reference to FIG. 4. A recording head 101 is structured with the electrothermal transducers 103, electrodes 104, liquid passage walls 105, and a ceiling plate 106 filmed on a substrate 102 through semiconductor fabrication processes such as etching, vapor deposition, and sputtering. Ink 112 is supplied from a liquid reservoiring chamber or holding (not shown) to a common liquid chamber 108 in the recording head 101 through an ink supply tube 107. In FIG. 4, a reference numeral 109 designates a connector for the ink supply tube. The ink 112 which is supplied into the common liquid chamber 108 is supplied to each of the liquid guides 110 (liquid passage) by a capillary phenomenon and is stably held on the discharging surface at the leading end of the liquid passage with the formation of meniscus. Here, the liquid on the surface of the electrothermal transducer is heated when the electrothermal transducer 103 is energized. Thus, a foaming phenomenon is created to cause the liquid droplet to be ejected by such a foaming energy from the discharging surface 111 (orifice surface 111). With a structure such as this, the recording head of a multiple discharging port for ink jet is produced by arranging a high density discharging ports of as much as 400 dpi.

When the ink cartridge 2 is inserted into the cartridge inlet of the ink jet recording apparatus, ink 2*a* in the ink cartridge 2 is supplied to the recording head 1 through the supply tube 8. An ink remainder sensor 11 detectes the remaining quantity of ink in the ink cartridge 2 to transfer the result thereof to a CPU 10. The ink remainder sensor 11 can be a negative pressure sensor using a diaphragm, for example. A cartridge sensor 3 detects whether the cartridge 2 is inserted into the cartridge inlet or not and transfers the result thereof to the CPU 10. In the present embodiment, the cartridge sensor 3 consists of a pair of electrodes in contact electrically with the resistors printed on the ink cartridge 2 to close the circuit when the ink cartridge 2 is inserted and to keep the circuit in an open state when it is not inserted; thus informing the CPU 10 of the presence of the ink cartridge 2. In this respect, it may be possible to adopt a spring switch or some other mechanism for this sensor 3, for example. The CPU 10 controls the printing process and others and at the same time, drives a pump 5 through a motor 6 and cam 7 and operates simultaneously the recovery operation by sucking ink from the recording head 1 through the airtight suction cap 4 in contact with the recording head 1. The ink which is sucked by the pump 5 is exhausted to a waste ink reservoir 12 through a waste liquid tube 9.

Now, with reference to FIG. 2, the operation of the present embodiment will be described. The CPU 10 executes the printing process (step S1) and checks the detection result of the ink remainder sensor 11 to determine whether ink is still left or not (step S2). If it is found that ink still remains, whether the ink cartridge 2 is inserted or not is determined (step S3). This step is taken because it may be possible to determine that ink still remains in the step S2 because of the atmospheric pressure even when the ink cartridge 2 is not inserted. In the step S3, if the presence of the cartridge 2 is ascertained, the printing process will be continued. If it is found in the step S3 that there is no cartridge 2, the printing is suspended (step S4), and then the absence of the ink cartridge 2 is displayed on a display (step S5).

When it is determined that there is no ink in the step S2, the printing is suspended (step S6) and no ink display is conducted (step S7). Then, the recording head 1 is moved to the home position (step S8) to determine whether the ink cartridge 2 is inserted or not (step S9). If the ink cartridge 2 is inserted, the process is at rest until the cartridge is removed. When the cartridge is removed, a signal is input to the CPU 10 from the cartridge sensor 3 accordingly. Receiving this signal the CPU 10 drives the motor 6 to execute the sucking operation (step S10). At this juncture, the suction is good enough if it can withdraw air in an amount more than the inner volume of the recording head (approximately 0.01 to 0.05 cc). It may also be possible to suck the ink in the supply tube 8 completely, of course. In the present embodiment, assuming that the sucking amount per suction by the pump is 0.1 cc, for example, the number of suctions (n times) should be good enough if it is one or more times.

Now, whether the sucking operations are executed for predetermined n times or not is determined (step S11). If it is yet to complete the n times, the process will return to the step S10. If it has completed the n times, the sucking operation is suspended and then whether the ink cartridge 2 is inserted or not is determined (step S12). If no ink cartridge 2 is inserted, the process is at rest until the ink cartridge 2 is inserted. When a new ink cartridge is inserted, the CPU 10 receives a signal from the cartridge sensor 3 accordingly to execute the sucking operation again (step S13). The amount of suction in this case must be good enough to allow ink in the supply tube and the recording head to be replaced completely. For example, assuming that the inner diameter of the supply tube is 1.5 mm and its length is 600 to 800 mm, the amount of ink in the supply tube is approximately 1 to 1.5 cc, and then provided that the amount of suction by the pump per time is 0.1 cc, the number of suctions (m times) will be 11 to 16 times taking also into account the amount of ink in the recording head. Subsequently, whether the sucking operation is executed for predetermined m times or not is determined (step S14). If it is yet to complete the m times, process will return to the step S13. If it has completed the m times, the READY indication is displayed (step S15) and then the printing is resumed as instructed (step S16).

As described above, if the operations along this flowchart are executed when ink cartridges are replaced, ink in the recording head is emptied once under any circumstances and then ink is refilled without even a single bubble. Also, all the passages are emptied once and bubbles such as created in the ink supply tube are completely removed. The frequency of the ink cartridge replacement is every 20 to 25 sheets of A3-sized 100% duty printing with the content of a cartridge being given as 30 g. Therefore, before bubbles become a size presenting any problems, they are removed. Also, the structures shown in FIG. 1 are the fundamental ones provided for an ink jet recording apparatus of the kind as minimum, and without adding any special components thereto, the above-mentioned effects can be obtained. Moreover, since the flow of ink is in only one way from the recording head to the cap, there is an advantage that dust and waste liquid in the cap will not enter the nozzles.

Figure 3:
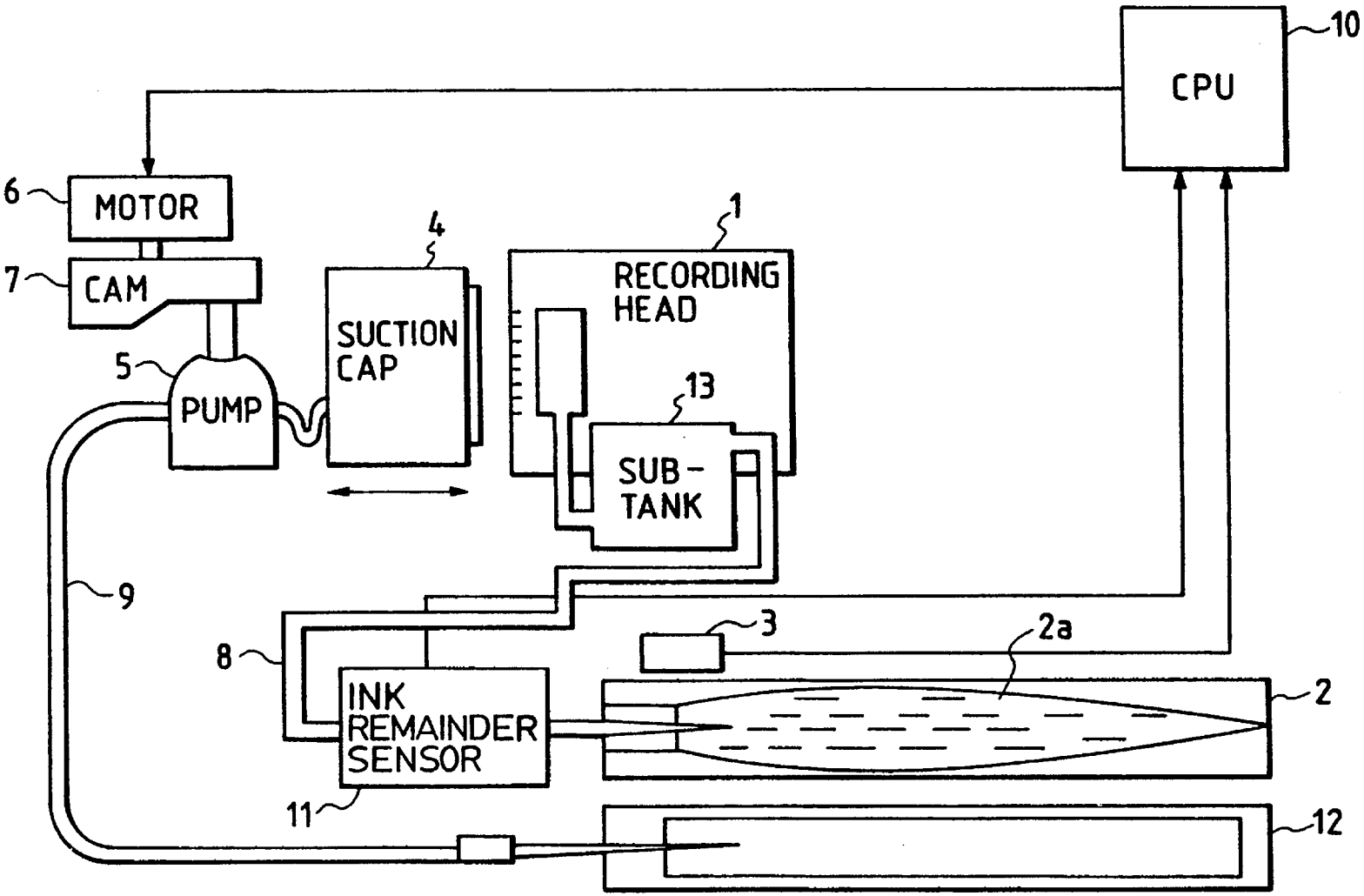
FIG. 3 is a view schematically showing another embodiment according to the present invention.

Subsequently, with reference to FIG. 3, the description will be made of another embodiment according to the present invention. As compared with the embodiment shown in FIG. 1, the present embodiment provides additionally a sub-tank 13 in the midway of the supply tube 8 between the recording head 1 and the ink cartridge 2.

The sub-tank 13 serves to protect ink from the vibration generated by bending of the supply tube 8 due to the recording head engaged in recording operations so as not to produce any adverse effect on the printing executed by the recording head 1. There is an air layer in the upper part of the subtank, which serves as a dumper. It also has an aim to catch minute bubbles in the supply tube 8. In this case, too, the bubble removing operation is substantially the same as those described in conjunction with FIG. 2, but the amount of the suction for the first time must be more than the amount of ink in the sub-tank 13 ( approximately 0.5 cc).

The present invention demonstrates excellent effects particularly with the recording head and recording apparatus using the thermal jet method among those using ink jet recording methods.

Regarding the typical structure and operational principle of such a method, it is preferable to adopt these which can be implemented using the fundamental principle disclosed in U.S. Pat. Nos. 4,723,129 and 4,740,796. This method is applicable to a so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head for the effective formation of a bubble in the recording liquid (ink) corresponding to each of the driving signals. By the production, development and contraction of the bubble, the liquid (ink) is ejected through a discharging port to produce at least one droplet. The driving signal is preferably in the form of a pulse because the development and contraction of the bubble can be effected instantaneously, and therefore, the liquid (ink) is ejected with quick response.

The driving signal in the form of the pulse is preferably such as disclosed in U.S. Pat. Nos. 4,463,359 and 4,345,262.

In addition, the temperature increasing rate of the thermoactive surface is preferably such as disclosed in U.S. Pat. No. 4,313,124 for excellent recordings in a better condition.

The structure of the recording head may be as shown in U.S. Pat. Nos. 4,558,333 and 4,459,600 wherein the thermoactive portion is disposed at a bent portion, as well as the structure of the combination of the discharging port, liquid passage, and the electrothermal transducer as disclosed in the above-mentioned patents (linear type liquid passage or right angle liquid passage).

In addition, the present invention is applicable to the disclosed in Japanese Laid-Open Patent Application No. 59-123670 wherein a common slit is used as the discharging port for plural electrothermal transducers, and to the structure disclosed in Japanese Laid-Open Patent Application No. 59-138461 wherein an opening for absorbing pressure wave of the thermal energy is formed corresponding to the ejecting portion.

Further, as the full line type recording head having a length corresponding to the width of a maximum recording medium on which a recording apparatus can perform its recording, it may be possible to adopt a structure such as satisfying the required length by combining plural recording heads disclosed in the above-mentioned patent specifications or a structure formed as a single recording head. The present invention demonstrates the above-mentioned effects more significantly irrespective of the structures adopted.

In addition, the present invention is effectively applicable to a replaceable chip type recording head which is connected electrically with the main apparatus and can be supplied with the ink when it is installed in the main apparatus, or to a cartridge type recording head provided integrally with the recording head.

Also, it is preferable to add the recording head recovery means and preliminary auxiliary means provided as constituents of a recording apparatus according to the present invention. They will make the effects of the present invention more stable. To name them specifically, they are capping means for the recording head, cleaning means, compression or suction means, preliminary heating means such as electrothermal transducers or heating elements other than such transducing type or the combination of those types of elements, and the preliminary ejection mode besides the regular ejection for recording.

Moreover, the present invention is extremely effective in its application to an apparatus having at least one of the monochromatic mode mainly with black, multi-color mode with different color ink materials and/or full-color mode using the mixture of the colors, which may be an integrally formed recording unit or a combination of plural recording heads.

As described above, according to the present invention, the sucking operation is performed by detecting the replacement of ink cartridges when they are replaced. It is therefore possible to easily remove the bubbles in the recording head, which are usually difficult to be removed, and to effectively maintain a desirable printing quality without any additional components and any resultant contamination in the nozzles.

What is claimed is:

1. An ink jet recording apparatus for performing recording by ejecting ink, said apparatus comprising:

a mounting section for accepting an exchangeable ink cartridge;

a head portion for forming desired images on a recording medium using ink introduced to said head portion from said ink cartridge through an ink passage on said mounting section, when said ink cartridge is in place on said mounting section; and a suction recovery device for performing a suction recovery operation for said head portion to introduce air into said ink passage from said mounting section when said ink cartridge is not installed in said apparatus.

2. An ink jet apparatus according to claim 1, wherein said suction recovery operation causes all of the ink in said ink passage to be exhausted through said head portion.

3. An ink jet apparatus according to claim 1, wherein said suction recovery operation is performed when said ink cartridge is removed from said apparatus.

4. An ink jet apparatus according to claim 1, wherein said suction recovery operation is sufficient to cause all of the ink in said head portion to be exhausted.

5. An ink jet apparatus according to claim 1, wherein said ink passage includes a sub-tank.

6. An ink jet apparatus comprising:

a mounting section for accepting an exchangeable ink cartridge for holding ink to be supplied to a head portion for ejecting ink to form desired images;

an ink supply passage between said mounting section and said head portion for supplying ink to said head portion from said ink cartridge;

suction recovery means covering a discharging surface of said head portion to perform suction of ink;

means for detecting removal of said ink cartridge from said apparatus; and means for performing a suction recovery operation for said head portion to introduce air into said supply passage from said mounting section by operating said suction recovery means when the removal of said ink cartridge is detected by said detecting means.

7. An ink jet apparatus according to claim 6, wherein said suction recovery operation performs suction to cause all of the ink in said ink supply passage to be exhausted through said head portion.

8. An ink jet apparatus according to claim 6, wherein said suction recovery operation is sufficient to cause all of the ink in said head portion to be exhausted.

9. An ink jet apparatus according to claim 6, wherein said ink supply passage includes a sub-tank.

10. A method of performing ink suction recovery, said method comprising the steps of:

providing an ink jet apparatus having a mounting section for accepting an exchangeable ink cartridge for holding ink to be used by a recording head to form desired images on a recording medium and an ink supply passage between said mounting section and said recording head for supplying ink to said recording head from said ink cartridge;

removing said ink cartridge from said mounting section; and thereafter performing a suction operation on discharging ports of said recording head to introduce air into said ink supply passage and said recording head from said mounting section.

11. A method of performing ink suction recovery according to claim 10 further comprising the steps of:

installing a new ink cartridge after all of the ink in said ink supply passage and recording head is exhausted; and performing a suction operation to refill said ink supply passage and recording head with ink.

12. An ink jet recording apparatus for forming images on a recording medium by ejecting ink from a recording head, said apparatus comprising:

a mounting section for accepting an exchangeable ink cartridge holding ink to be supplied to said recording head through an ink supply passage between said mounting section and said recording head;

suction means for placement in airtight contact with said recording head to suck ink from said recording head;

installation detecting means for detecting removal of said ink cartridge and installation of a new ink cartridge; and control means for performing of said recording head by driving said suction means to execute a sucking operation to introduce air into said supply passage from said mounting section each time removal of said ink cartridge is detected and to introduce ink into said supply passage and recording head each time installation of said ink cartridge is detected.

13. An ink jet apparatus according to claim 12, wherein all of the ink in said ink supply passage is removed by said suction means at removal of said ink cartridge.

14. An ink jet apparatus according to claim 12, wherein said suction means is driven to refill said ink supply passage with ink when an ink cartridge is again installed.

15. An ink jet apparatus according to claim 12, wherein said ink supply passage includes a sub-tank.

16. A method of performing ink suction recovery, said method comprising the steps of:

providing an ink jet apparatus having a mounting section for accepting an exchangeable ink cartridge for holding ink to be supplied to a head portion for ejecting ink to form desired images and an ink supply passage between said mounting section and said head portion for supplying ink to said head portion from said ink cartridge;

detecting a removal of said ink cartridge from said apparatus; and afterwards performing a suction recovery operation on a discharging surface of said head portion to introduce air into said supply passage from said mounting section.

* * * * *

UNITED STATES PATENT AND TRADEMARK OFFICE

CERTIFICATE OF CORRECTION

PATENT NO. : 5,592,200

DATED : January 7, 1997

INVENTOR(S) : MINEO KANEKO

It is certified that error appears in the above-identified patent and that said Letters Patent is hereby corrected as shown below:

ON THE TITLE PAGE

IN THE ABSTRACT

Line 2, "portion" should read --portion,--.

COLUMN 1

Line 54, "for;" should read --for--.
Line 60, "chamber to generate" should read --chamber, thus generating--.
Line 63, "wherein" should read --wherein an--.

COLUMN 2

Line 43, "simply" should read --simple--.
Line 56, "exchangeable an" should read --an exchangeable--.

COLUMN 3

Line 25, "suction the" should read --the suction-- and "the" (second occurrence) should be deleted.
Line 62, "chamber or holding" should read --or holding chamber--.

COLUMN 5

Line 20, "process" should read --the process-- and "to the" should read --to--.

UNITED STATES PATENT AND TRADEMARK OFFICE

CERTIFICATE OF CORRECTION

PATENT NO. : 5,592,200

DATED : January 7, 1997

INVENTOR(S) : MINEO KANEKO

It is certified that error appears in the above-identified patent and that said Letters Patent is hereby corrected as shown below:

COLUMN 8

Line 16, "claim 10" should read --claim 10,--.

Signed and Sealed this

Twenty-fourth Day of June, 1997

Bruce Lehman

*Attest:*

BRUCE LEHMAN

*Attesting Officer*

*Commissioner of Patents and Trademarks*